United States Patent [19]

Spinelli et al.

[11] Patent Number: 4,692,280

[45] Date of Patent: Sep. 8, 1987

[54] PURIFICATION OF FISH OILS

[75] Inventors: John Spinelli; Virginia F. Stout; William B. Nilsson, all of Seattle, Wash.

[73] Assignee: The United States of America as represented by the Secretary of Commerce, Washington, D.C.

[21] Appl. No.: 936,305

[22] Filed: Dec. 1, 1986

[51] Int. Cl.[4] ..... C11B 3/00

[52] U.S. Cl. ..... 260/420; 260/405.5; 260/410.7

[58] Field of Search ..... 260/420, 405.5

[56] References Cited

U.S. PATENT DOCUMENTS 4,554,107 11/1985 Takao ..... 260/420 X

*Primary Examiner*—Werren B. Lone
*Assistant Examiner*—Vera C. Clarke
*Attorney, Agent, or Firm*—Alvin Englert; Albert Tockman

[57] ABSTRACT

Fish oil is purified by extraction with supercritical carbon dioxide.

4 Claims, 1 Drawing Figure

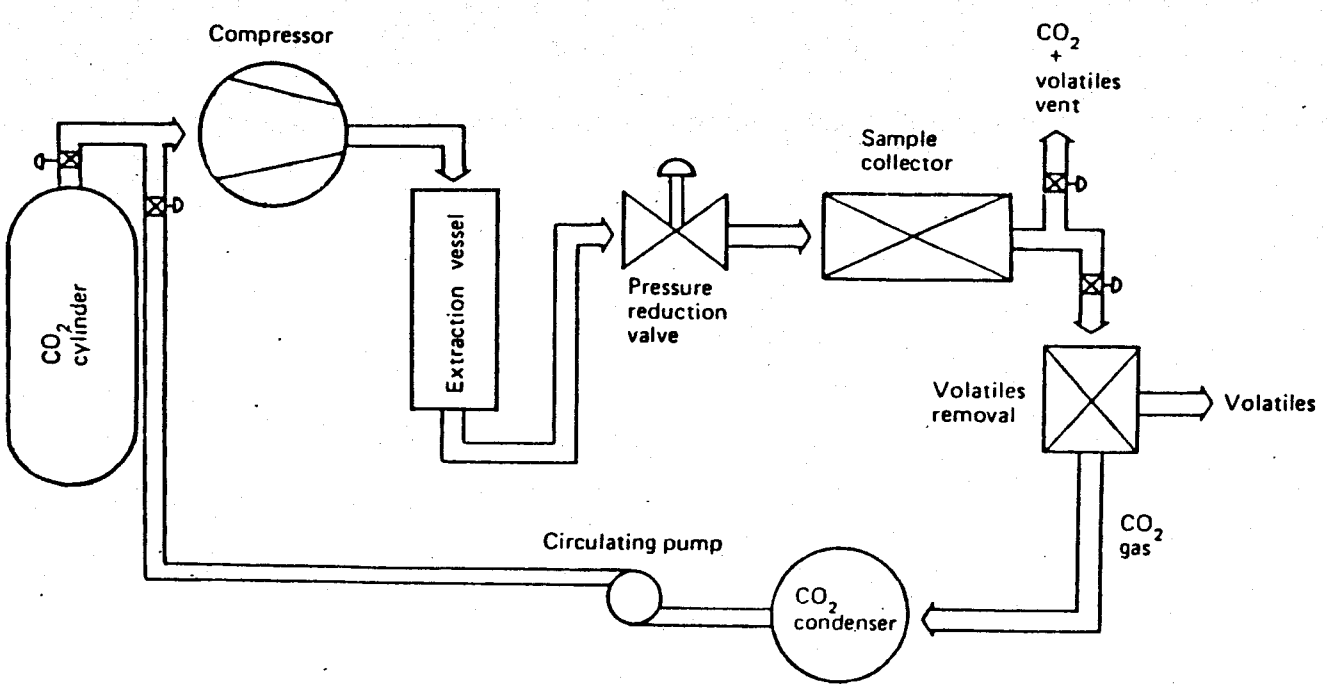
Compressor
Extraction vessel
Pressure reduction valve
Sample collector
$CO_2$ + volatiles vent
Volatiles removal
Volatiles
$CO_2$ gas
$CO_2$ condenser
Circulating pump
$CO_2$ cylinder

PURIFICATION OF FISH OILS

The present invention relates to a process for the purification of fish oils.

BACKGROUND OF THE INVENTION

Fish oils comprise a complex mixture of fatty acid moieties, mostly straight chain with an even number of carbon atoms. The fatty acids, usually present as their glycerides, are either saturated or mono- or polyunsaturated. Unlike vegetable oils and fats from terrestrial animals, which contain mainly fatty acids having a maximum of eighteen carbons and two or three double bonds, fish and marine mammal oils contain substantial amounts of fatty acids having twenty or twenty-two carbons and four, five or six double bonds, Stansby, "Fish Oils", Avi Publishing Company, Inc. (1967). Among the fatty acid moieties unique to fish oils are the following n-3 compounds: 18:4, 20:4, 20:5, 22:4, 22:5, and 22:6. The n-3 designation means that the first double bond begins at the third carbon counting from the methyl end of the chain. In the number: number designation, the first number indicates chain length and the second number indicates how many double bonds are present. For example, 18:4 indicates a straight chain fatty acid having eighteen carbon atoms and four methylene-interrupted double bonds.

In addition to fatty acid glycerides, fish oils contain numerous other substances such as cholesterol, cholesterol esters, wax esters, hydrocarbons like squalene, pigments like chlorophyll and astaxanthin, amines, and phospholipids, as well as products of autoxidation and the heating of proteinaceous materials. Many of these substances contribute to the unpleasant oder and flavor of fish oils. For instance, cod liver oil, as sold in drugstores, has a notoriously strong smell and taste. The offending substances cannot be removed readily by traditional processing techniques without damaging or destroying the polyunsaturated components of the oil.

Up until World War II, the nutritionally important components of cod liver oil were Vitamin A and Vitamin D, but now these substances are produced synthetically. More recently, it has been observed that Greenland Eskimos, whose food intake comprises mainly fish and marine animals, exhibit unusually low incidences of cardiovascular diseases, and a number of chronic degenerative diseases such as arthritis, diabetes and ulcerative colitis. Fish and marine oils are now recognized to be of value because they contain substantial quantities of polyunsaturated fatty acids, important dietary factors beneficial in reducing the development of atherosclerotic lesions, Dyerberg et al, "Nutritional Evaluation of Long-chain Fatty Acids in Fish Oil", pages 245–261, Academic Press, London (1982). Eicosapentaenoic acid (EPA or 20:5 n-3) and docosahexaenoic acid (DHA or 22:6 n-3) in particular, and other polyunsaturated fatty acids having their double bonds in the cis-configuration appear most beneficial.

Commercially available fish oils, such as cod liver oil, are not suitable for prolonged use as a nutritional supplement or as a medicament for the prevention or treatment of disease. The high concentrations of Vitamins A and D and also the toxic products of autoxidation, post-death metabolism and processing render them highly unpalatable and, more importantly, unwholesome. Extended use of fish oils in the diet would require removal of toxic as well as unpalatable components.

DISCUSSION OF THE PRIOR ART

Current processes for purifying fish oils are inappropriate, cumbersome and detrimental to the relativley labile polyunsaturated fatty acid moieties unique to fish oils. Traditional methods for the commercial refining of fish oils utilize treatment with activated charcoal or with diatomaceous earth, clay bleaching, alkali refining, hydrogenation and/or vacuum steam stripping. Hydrogenation destroys polyunsaturation and steam deoderization at temperatures of above 205° C. may lead to rearrangement of the methylene-interrupted double bonds to transand/or conjugated double bonds. Such changes reduce the amount of desirable cis-polyunsaturated fatty acids present, and may also induce the formation of toxic products.

Molecular distillation has been used to prepare fish oils in research quantities, but thus far the process has not been scaled up to commerical production. Since the oil is subjected to a temperature of at least 190° C., heat can induce detrimental changes in the polyunsaturated acids present.

Supercritical carbon dioxide, which is carbon dioxide under high pressure above its critical temperature of 31° C., i.e., carbon dioxide gas non-liquefiable under pressure, is known to have selective solvent properties for the preparation of human food-grade products. For example, U.S. Pat. No. 4,495,207 describes its use in extracting lipids from corn germ. Supercritical carbon dioxide is used commercially for the removal of caffeine from coffee and in the extraction of the essence of hops for use in the brewing of beer. The fractionation of fish oil esters using supercritical carbon dioxide is described by Eisenbach, *Ber. Bunsenges, Phys. Chem.*, 88, 882–887 (1984) and in commonly assigned copending application Ser. No. 879,543, filed June 24, 1986.

SUMMARY OF THE INVENTION

Supercritical carbon dioxide has now been found to be a superior substance for purifying fish oils. The unique properties of supercritical carbon dioxide provide a selective system for separating deleterious and undesirable substances from fish oils. Odor bodies, pigments, and products of autoxidation that contribute to the unattractive and toxic properties of fish oils are readily separated from the major and desired polyunsaturated fatty acid triglyceride components. In a first step, supercritical carbon dioxide selectively extracts the volatile and odorcausing constituents of fish oil. In a second step, supercritical carbon dioxide selectively extracts fatty acid glycerides from oxidized and colored materials. Repetition of the extractions yields a relatively high quality triglyceride.

The process of the present invention avoids conditions which can lead to the destruction of the polyunsaturated fatty acid moieties unique to fish oils. Extraction with carbon dioxide is effected at moderately elevated temperatures, which limit autoxidation, decomposition, isomerization and/or polymerization of those polyunsaturated moieties. The inert atmosphere of carbon dioxide prevents oxygen-induced reactions, the cause of autoxidation, and extraction at low temperatures leaves intact the methylene-interrupted cis double bonds required for physiological activity. Finally, carbon dioxide, unlike most other solvents, is non-toxic, nonflammable and leaves no undesirable residue.

More specifically, the present invention is a process for the purification of fish oil which comprises extracting the fish oil with supercritical carbon dioxide at a pressure of 1070 to 10,000 psi and a temperature of 35° C. to 95° C. first to remove odoriferous and volatile impurities present in the fish oil and then with additional supercritical carbon dioxide to separate lightly colored fish oil from a more darkly colored residue.

In a preferred embodiment, the lightly colored fish oil obtained by extraction is extracted with further portions of supercritical carbon dioxide to remove odoriferous and volatile impurities and then to separate almost colorless fish oil from a darker colored residue.

BRIEF DESCRIPTION OF THE DRAWING

The FIGURE in the drawing is a flow diagram illustrating the apparatus utilized in practicing the process of the invention.

DESCRIPTION OF THE INVENTION

Conventional equipment may be utilized in practicing the process of the present invention. In the specific embodiment illustrated in the drawing, fish oil is charged into an extraction vessel. Oxygen is purged from the system by passing carbon dioxide through the system or preferably by pressurizing to 150–200 psi with carbon dioxide and venting the gases. The process is repeated three or four times and then 150 psi carbon dioxide is admitted again. As the extraction vessel and preheater (not shown, located between the compressor and the reaction vessel) are heated to the desired temperature, the pressure is increased to the desired pressure. Care is taken to avoid overheating that could decompose the sensitive polyunsaturated structures present or alter adversely the organoleptic properties of the fish oil to be extracted.

After the desired pressure (1070 to 10,000 psi) and temperature (35° C. to 95° C.) have been attained, extraction is begun by opening the pressure reduction valve, thus allowing supercritical carbon dioxide to flow through the crude oil in the extraction vessel. The components of the oil that are most soluble in the carbon dioxide, including the low-molecular-weight, odoriferous products of autoxidation, pass out of the starting material, through the pressure reduction valve, and into the sample collector.

Expansion of the solution at atmospheric pressure causes solid carbon dioxide and fish oil components to collect in the sample collector. The carbon dioxide is measured to determine the volume used and then vented. Alternatively, the carbon dioxide can be recycled after removal of the odoriferous volatile components.

When the first fraction has passed over, the pressure reduction value is closed to remove the collected material and to install a second sample collector. Subsequent fractions are collected as detailed for the first fraction.

The extracted material present in each fraction is recovered by warming that fraction to room temperature and allowing the carbon dioxide to escape or be recycled if desired. When collecting the first fraction, the most volatile odoriferous components pass through the sample collector without condensing. The components of the fish oil less soluble or insoluble in supercritical carbon dioxide remain behind in the extraction vessel as a residue or composed of polymers, proteins, pigments, phospholipids, etc. Undesired fractions, generally the first and last fractions, and the residue are discarded.

Operating in this manner, the volatile odoriferous materials and the less soluble or insoluble residues of colored, decomposed, and polar substances are separated from the triglycerides which comprise the main component of crude fish oils. Thus, lightly colored, mild smelling fish oils are obtained from crude fish oils. By repeating the process twice, the final oil is nearly water white and only faintly flavored.

A list of fish oils which can be purified by the process of the present invention would include menhaden oil; albacore, skipjack, yellowfin, bluefin, and other tuna cooker, scrap, and liver oil; bonito (any species) oil; pollock liver oil; Pacific whiting (or hake) body and organ oil; mackeral (any species) oil; jack mackeral oil; capelin oil; Atlantic salmon "head" oil including collars, tails, and fins, and scrap oil; pink, chum, coho, sockeye, chinook salmon "head" oil, and scrap oil; anchovy oil; anchoveta oil; sardine oil; chub oil; sablefish body, scrap, and organ oil; herring oil; thread herring oil; dogfish and other shark liver oil; sturgeon oil; eel oil; pilchard oil; shad oil; alewife oil; smelt oil; rockfish (any species) oil; cod (any species) scrap or liver oil; halibut liver (Atlantic and Pacific) oil; swordfish liver oil; pomfret (Pacific and Atlantic) oil; atka mackerel (greenlings) oil; sole body and liver oil; and flounder body and liver oil.

Our invention is further illustrated by means of the following non-limiting examples utilizing commercially available crude fish oils:

EXAMPLE 1

Purification of Herring Oil

Using the procedure described above, 7.2 g of crude herring oil was loaded onto a borosilicate glass wool support in the extraction vessel. After the vessel was connected into the high pressure system, it was purged with 50 liters of $CO_2$ to remove oxygen. The temperature was raised briefly to 70° C. and the pressure to 4700–4900 psi, and flow of $CO_2$ was begun. Four fractions were collected. Experimental details are shown in Table 1. (All volumes of $CO_2$ were measured at ambient conditions.)

TABLE 1

| Fraction | Temperature °C. | $CO_2$ liters | Yield Weight | Yield % | Color | Odor |
|---|---|---|---|---|---|---|
| 1 | 43 | 110 | 0.87 | 12 | Faint Yellow | Disagreeably fishy |
| 2 | 78 | 130 | 1.72 | 24 | Colorless | Faint, oily |
| 3 | 72 | 140 | 1.42 | 20 | Colorless | |
| 4 | 74 | 390 | 1.64 | 23 | Bright Yellow | Fishy |
| Total | | 770 | 5.65 | 78 | | |

Fraction 2, representing 24% of the starting material, was colorless and almost odorless. The residual odor was very faintly oily, a vast improvement over the disagreeably fishy odor of the starting material.

EXAMPLE 2

Purification of Tuna Oil

Using the procedure essentially as described above, 7.0 g of a dark brown, opaque and foul smelling crude tuna oil was loaded into the extraction vessel. The system was purged with 45 liters of $CO_2$, and the tuna oil extracted with supercritical $CO_2$ at 85° at successively higher pressures, begining at 1300 and proceeding in stages up to 6000 psi. Seven fractions were collected, each by extraction with approximately 200 liters of $CO_2$. The purge gas and the first fraction contained most of the odoriferous materials. By the end of the first fraction the extract was colorless and exhibited a slight odor. The next five fractions were very pale yellow and only mildly fishy smelling, and weighed a total of 3.7 g, a 52% yield. The seventh fraction, weighing 1.5 g or 21% of the starting material, was pale yellow and had a slightly fishy odor. A dark residue remained in the extraction vessel. The color and odor of the middle fractions were remarkable considering the color and odor of the crude oil starting material.

EXAMPLE 3

One-Stage Purification of Menhaden Oil

Using the procedure essentially as described above, 7.25 g of crude menhaden oil was loaded into the extraction vessel and the system purged of oxygen by raising the pressure to approximately 250 psi with compressed $CO_2$ and venting back to atmospheric pressure several times. Then the system was equilibrated at 80° C. and 6000 psi before beginning the flow of $CO_2$. Four fractions were collected. Experimental details are shown in Table 2.

TABLE 2

| Fraction | $CO_2$ Liters | Yield Weight | Gardner % | Gardner Color* | Odor |
|---|---|---|---|---|---|
| Crude Oil | | 7.25 | — | 13 | Strong, painty, fishy |
| 1 | 65 | 2.04 | 28.1 | 9–10 | Strong, burnt |
| 2 | 100 | 3.03 | 41.8 | 7 | Slight burnt, painty |
| 3 | 100 | 2.15 | 29.7 | 11 | Painty, sweet |
| 4 | 80 | 0.14 | 1.9 | 12–13 | Stronger, oily |
| Total | 345 | 7.36 | 101.5 | | |

*All color measurements were made using 2-ml vials

Fraction 2 was the lightest in color, but had a slight burnt odor that was less pleasant than that of Fraction 3.

EXAMPLE 4

Multi-Stage Purification of Menhaden Oil

Using the procedure essentially as described above, 20 g of crude menhaden oil was extracted at 80° C. and 4000 psi until approximately 7% of the oil was collected. To obtain the subsequent fractions, the crude oil was extracted at 7000 psi. In the second stage, fractions 2, 3 and 4 from the first stage were extracted at 80° C. and initially at 5000 psi. The major portion was extracted at 7000 psi. Fractions 2 and 3 from the second stage purification were combined and extracted with supercritical $CO_2$ initially at 6000 psi. After the forerun has been collected, the remaining material was extracted at 7000 psi. Experimental details are shown in Table 3.

TABLE 3

| Fraction | P psi | $CO_2$ liters | Yield g | Gardner % | Gardner Color* | Odor |
|---|---|---|---|---|---|---|
| | | | First stage | | | |
| Starting oil | | | 20.87 | | | |
| 1 | 4000 | 100 | 1.41 | 6.8 | 8 | Strongly burnt, foul |
| 2 | 7000 | 50 | 4.53 | 21.7 | 9–10 | Mild burnt |
| 3 | 7000 | 111 | 7.45 | 35.7 | 7 | Moderately grassy |
| 4 | 7000 | 100 | 4.94 | 23.7 | 8 | Moderately grassy |
| 5 | 7000 | 100 | 1.76 | 8.4 | 11 | Mild grassy |
| Total | | 461 | 20.10 | 96.3 | | |
| | | | Second Stage | | | |

TABLE 3-continued

| Fraction | P psi | $CO_2$ liters | Yield g | Gardner % | Gardner Color* | Odor |
|---|---|---|---|---|---|---|
| Feed | | | 15.11 | | | |
| 1 | 5000 | 100 | 1.34 | 8.9 | 5 | Moderately burnt |
| 2 | 7000 | 100 | 4.74 | 31.4 | 5–6 | Moderately grassy |
| 3 | 7000 | 100 | 5.06 | 33.5 | 5–6 | Moderately grassy |
| 4 | 7000 | 103 | 3.18 | 21.0 | 10 | Moderately grassy |
| Total | | 403 | 14.32 | 94.8 | | |
| | | | Third Stage | | | |
| Feed | | | 8.51 | | | |
| 1 | 6000 | 50 | 1.4 | 16 | 3–4 | Mild, grassy |
| 2 | 7000 | 50 | 2.35 | 27.6 | 2–3 | Mild, watermelon |
| 3 | 7000 | 50 | 2.44 | 28.7 | 2–3 | Mild, watermelon |
| 4 | 7000 | 50 | 1.96 | 23.0 | 7 | Mild, watermelon |
| Total | | 200 | 8.15 | 95 | | |

*All color measurements were made using 2-ml vials

Fractions 2 and 3 from the third stage of purification amounted to approximately 23% of the crude menhaden oil processed. The oil thus purified was nearly water white, had a Gardner number of 2 to 3 and a mild faintly watermelon rind taste.

The three-stage process of purification did not destroy the sensitive polyunsaturated fatty acid moieties present in the oil. For example, the crude oil contained 15.1% EPA and 8.0% DHA; after purification, the oil contained 16.1% EPA and 9.6% DHA. Comparative data for these and the other major fatty acid moieties present in the oil are shown in Table 4.

TABLE 4

| Fatty acid | 14:0 | 16:0 | 16:1 | 18:0 | 18.1 | 20:5 | 22.5 | 22.6 |
|---|---|---|---|---|---|---|---|---|
| Crude oil | 9.7 | 18.1 | 12.5 | 2.5 | 14.2 | 14.1 | 2.3 | 9.0 |
| Processed oil | 9.0 | 18.2 | 11.9 | 3.1 | 14.4 | 16.1 | 2.2 | 9.6 |

What is claimed is:

1. A process for the purification of fish oil which comprises extracting the fish oil with supercritical carbon dioxide at a pressure of 1070 to 10,000 psi and at a temperature of 35° C. to 95° C. first to remove odoriferous and volatile impurities present in the fish oil and then with additional supercritical carbon dioxide to separate lightly colored fish oil from a more darkly colored residue.

2. A process according to claim 1, wherein the lightly colored fish oil is extracted with a further portion of supercritical oxide to remove odoriferous and volatile impurities and then with a further portion of supercritical carbon dioxide to separate almost colorless fish oil from a darker colored residue.

3. A process according to claim 1, wherein the fish oil is menhaden oil; albacore, skipjack, yellowfin, bluefin, and other tuna cooker, scrap, and liver oil; bonito oil; pollock liver oil; Pacific whiting, body and organ oil; mackeral oil; jack mackeral oil; capelin oil; Atlantic salmon, head oil and scrap oil; pink, chum, coho, sockeye, chinook salmon head oil and scrap oil; anchovy oil; anchoveta oil; sardine oil; chub oil; sablefish body, scrap, and organ oil; trout waste and organ oil; herring oil; thread herring oil; dogfish and other shark liver oil; sturgeon oil; eel oil; pilchard oil; shad oil; alewife oil; smelt oil; rockfish oil; cod, scrap or liver oil; halibut liver oil; swordfish liver oil; pomfret oil; atka mackerel (greenlings) oil; sole, body and liver oil; and flounder, body and liver oil.

4. A process according to claim 2, wherein the fish oil is menhaden oil; albacore, skipjack, yellowfin, bluefin, and other tuna cooker, scrap, and liver oil; bonito oil;

pollock liver oil; Pacific whiting, body and organ oil; mackerel oil; jack mackeral oil; capelin oil; Atlantic salmon, head oil and scrap oil; pink, chum, coho, sockeye, chinook salmon head oil and scrap oil; anchovy oil; anchoveta oil; sardine oil; chub oil; sablefish body, scrap, and organ oil; trout waste and organ oil; herring oil; thread herring oil; dogfish and other shark liver oil; sturgeon oil; eel oil; pilchard oil; shad oil; alewife oil; smelt oil; rockfish oil; cod, scrap or liver oil; halibut liver oil; swordfish liver oil; pomfret oil; atka mackeral (greenlings) oil; sole, body and liver oil; and flounder, body and liver oil.

* * * * *